United States Patent [19]

Clyburn

[11] Patent Number: 4,936,698

[45] Date of Patent: Jun. 26, 1990

[54] PRINTER STAND WITH PRINT-OUT CATCHER

[75] Inventor: C. Wayne Clyburn, Cincinnati, Ohio

[73] Assignee: Hunt Holdings, Inc., Wilmington, Del.

[21] Appl. No.: 205,845

[22] Filed: Jun. 13, 1988

[51] Int. Cl.[5] ..... B41J 15/04

[52] U.S. Cl. ..... 400/613.2; 248/676; 312/208; 400/691

[58] Field of Search ..... 400/691, 611, 613.2; 312/208, 108, 258, 259; 248/676, 473, 1 B

[56] References Cited

U.S. PATENT DOCUMENTS

| | | | |
|---|---|---|---|
| 4,522,521 | 6/1985 | Scott | 400/613.2 |
| 4,544,065 | 10/1985 | Mueller | 211/13 |
| 4,568,212 | 2/1986 | Cooke et al. | 400/691 |
| 4,570,802 | 2/1986 | Murphy | 211/13 |
| 4,685,647 | 8/1987 | Calhoun | 248/473 X |
| 4,693,444 | 9/1987 | Williams et al. | 248/1 B X |
| 4,707,156 | 11/1987 | Clark | 400/613.2 |
| 4,749,295 | 6/1988 | Bankier et al. | 312/208 X |

OTHER PUBLICATIONS

"Display Detachable Printer Stand", by Gilvey et al., *IBM Technical Disclosure Bulletin,* vol. 27, No. 1A, Jun. 1984.

"Turn Printer Chaos into Space-Saving Efficiency. Choose From 5 Desktop Stands-All under $55!", (Personal Computer Products, p. 116) (Exhibit A).

*Primary Examiner*—Edgar S. Burr
*Assistant Examiner*—Moshe I. Cohen
*Attorney, Agent, or Firm*—Alexis Barron; Albert L. Free

[57] ABSTRACT

A printer stand comprises a support base for holding a rear-ejection printer and a paper catcher mounted to the rear of said printer and extending rearwardly and upwardly therefrom. The catcher comprises a flat backer panel having bent-up side flanges and having a bent-up lower ledge for supporting the lower edge of a packet of sheets of paper resting against the backer panel. The catcher is mounted to the base for easy removal by providing a forwardly and downwardly extending slot at the rear of each side wall of the support base, into and out of which the panel can readily be slid; the side flanges are preferably spaced apart by only slightly more than the distance between the outer sides of the side walls, and the ledge is preferably at about right angles to the packer panel. The system provides stable support of the packet of sheets, is easily assembled and disassembled, and is inexpensively made from a single metal sheet by bending up the side flanges and the ledge.

6 Claims, 4 Drawing Sheets

25
27
20
24
16
10
26
28
14
50
22
29
19
12

28
24
25
27

26
50
10
16
31
18
29
12
52
22
23
32
30
14

PRINTER STAND WITH PRINT-OUT CATCHER

BACKGROUND OF THE INVENTION

Printer stands are known which employ a basically box-like base on which a computer printer is placed during normal operation. The printer used with such stands is typically of the relatively small, desk-top type commonly employed with personal computers, which is normally fed from a packet of fanned computer print-out paper, and which produces print-out copy in a continuous strip readily foldable into a fanned packet like that from which the printer is fed.

Normally the printer in such case is fed with its supply of print-out paper at its lower rear end, or through the middle of its bottom, and to permit this the stand may be provided with two openings in its top, one near its center and one near its rear, through which the supply paper can move freely into the printer from a pile of paper stock stored below the printer. The print-out paper normally emerges from the printer at its top and is fed upward and rearwardly of the printer.

Commonly, there is provided some type of print-out catcher, such as a simple horizontal box or tray on the desk behind the printer, for receiving and accumulating the printout paper from the printer. A variety of configurations and locations for such print-out catchers are known in the prior art. Some are actually located under the printer, for example below the desk top, and the print-out paper fed downward along a circuitous path for accumulation therein; in cases a print-out catcher in the form of a mesh basket extends horizontally outwardlly from the back of the printer.

It is also known to use a catcher in the form of a slanted mesh-type basket, designed to be removably secured to the top rear surface of the base so as to extend upwardly and backwardly from the printer, in which the print-out paper is collected as it emerges from the printer. This configuration of basket tends to conserve space behind the printer, and places the print-out paper in a somewhat upright position so that it can easily be scanned and easily reached to handle it or to check through it, for example.

One form of such upwardly angled mesh basket is designed to be mounted to the top rear of the base member by means of a pair of rods, suitably formed by extensions of the mesh of the basket, which protrude forwardly near each side of the basket so that they can be simultansouely slid through a pair of corresponding holes in the rear of the top portion of the base member. The holes may be sufficiently larger than the rods so that, when the basket is released from manual support, it pivots slightly downwardly from the vertical under gravity until the rods in the holes prevent further motion. The basket is removed, when desired, by pulling the basket upwardlY and rearwardly to slide the rods out of the holes, thereby providing access to the rear of the printer.

One drawback of such a catcher arrangement is that it is quite expensive to fabricate. It is normally made of relatively heavy rod stock, typically chromium-plated, with many welds or other forms of attachments of the various rods to each other to form a suitable mesh for confining the print-out paper when it falls into the basket, and using rod stock sufficiently thick that it will provide the necessary strength for effectively cantilevering the weight of the basket and its paper contents outwardly and rearwardly from the above-mentioned pair of holes in the top of the base.

It is therefore an object of the present invention to provide a new and useful print-out paper catcher, and a new and useful combination printer support base and paper catcher, which are simpler and less expensive to fabricate than previously-known apparatus providing comparable performance.

Another object is to provide such a combination catcher and support base in which the catcher is easy to mount and demount from the base, and yet is strong and unlikely to deform during use.

A further object is to provide such a catcher which can be made by performing simple cutting and bending operations on a single piece of sheet metal.

SUMMARY OF THE INVENTION

These and other objects of the invention are achieved by the provision of a print-out paper catcher preferably made from a single continuous piece of metal plate, and by the provision of a new and useful construction of catcher and support base for releasably securing the catcher to the associated printer support base.

More particularly, the catcher of the invention preferably comprises a flat panel having a bent-up ledge along a central portion of its lower edge for supporting a packet of print-out paper accumulated in the catcher while the catcher is in position on the printer support base, and a pair of downwardly and forwardly extending slots near the rear ends of the side walls of the support base into which the rear catcher plate can be slid for easy assembly in the desired upwardly and rearwardly extending position to receive and accumulate the print-out paper emerging from the printer. To restrain the print-out paper from undesired sideways motion and to assure placement of the catcher plate in the slots in the proper sideways position, there are preferably also provided bent-up flanges on each side of the catcher plate, in positions just outboard of the slotted portions of the sidewalls of the base plate, so that when the catcher plate is in position the flanges lie just outside of the latter sidewalls. The catcher is easily removed to provide access to the rear of the printer, by merely sliding it upwardly and rearwardly out of the slots in the support base.

The print-out paper catcher utilized in this invention can readily be made by starting with a simple rectangular sheet of metal which is appropriately slitted to permit bending up of a ledge along the central part of its lower edge and of side flanges along both side edges of the catcher. It will readily be appreciated how inexpensive it is to provide such a bent-up catcher plate, and how easily it may be assembled or disassembled from the base by slidinq it into or out of the slots in the rear ends of the sidewalls of the base member.

The input feed to the printer on the stand may be provided in any standard way. The printer base shown in the figures of this application has a central slot through which paper may be fed directly upwardly into a bottom-feed type printer, but the paper may also be fed around the upper back edge of the top of the base plate and in front of the catcher ledge for rear feeding of paper to printers requiring this type of paper supply. In either case the output motion of the paper is upwardly and rearwardly so as to cascade rearwardly and downwardly onto the ledge of the catcher plate, for accumulation thereon.

BRIEF DESCRIPTION OF FIGURES

These and other objects and features of the invention will be more readily understood from a consideration of the following detailed description taken with the accompanying drawings, in which.

DETAILED DESCRIPTION OF SPECIFIC EMBODIMENTS

Figure 2:
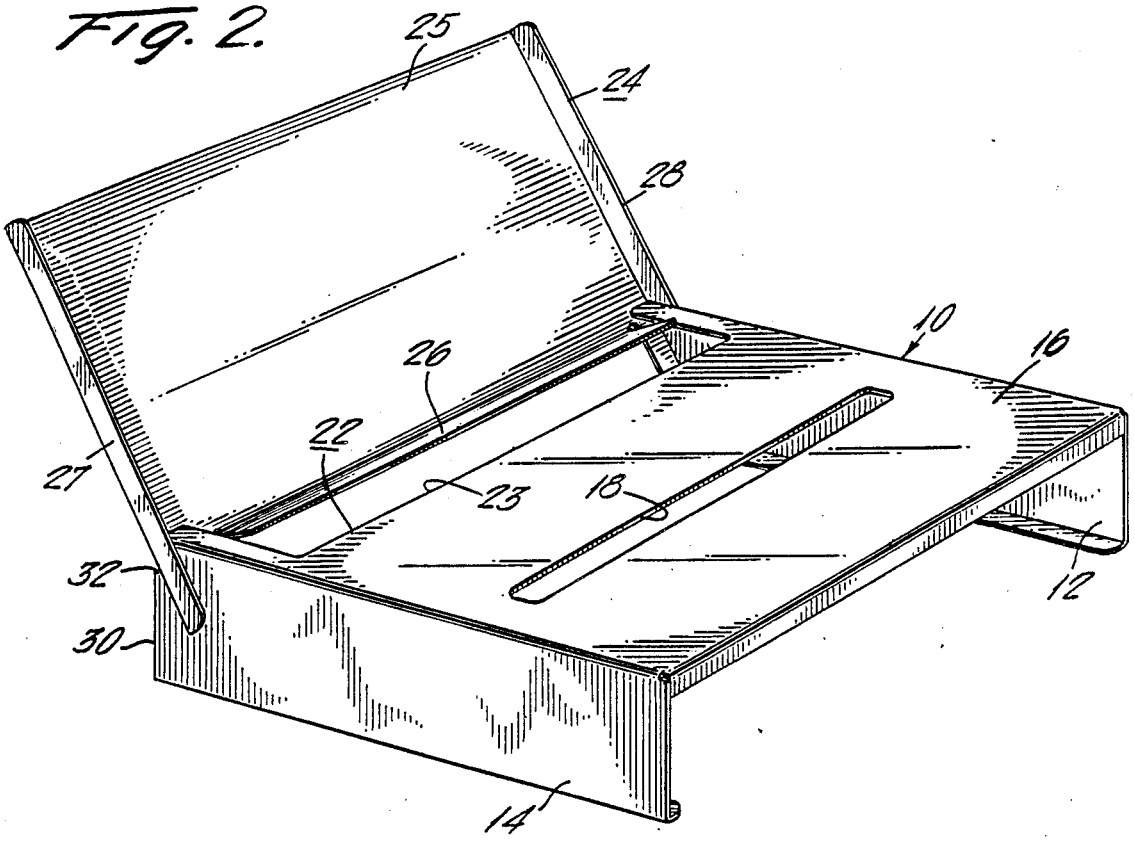
FIG. 2 is a perspective view of the stand of FIG. 1, with the printer removed.
Figure 3:
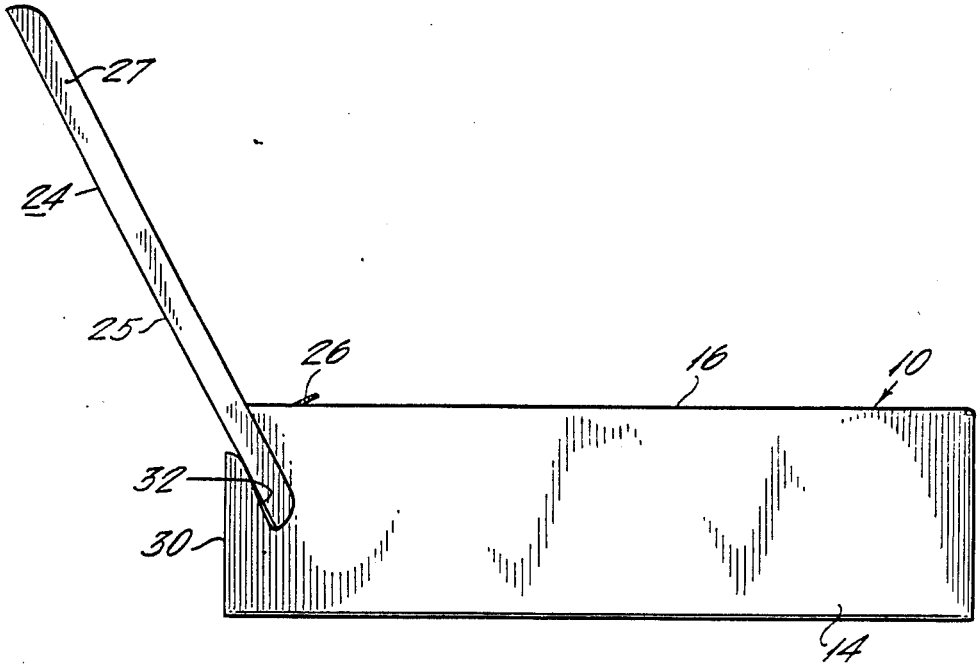
FIG. 3 is an end view of the stand of FIG. 2.
Figure 4:
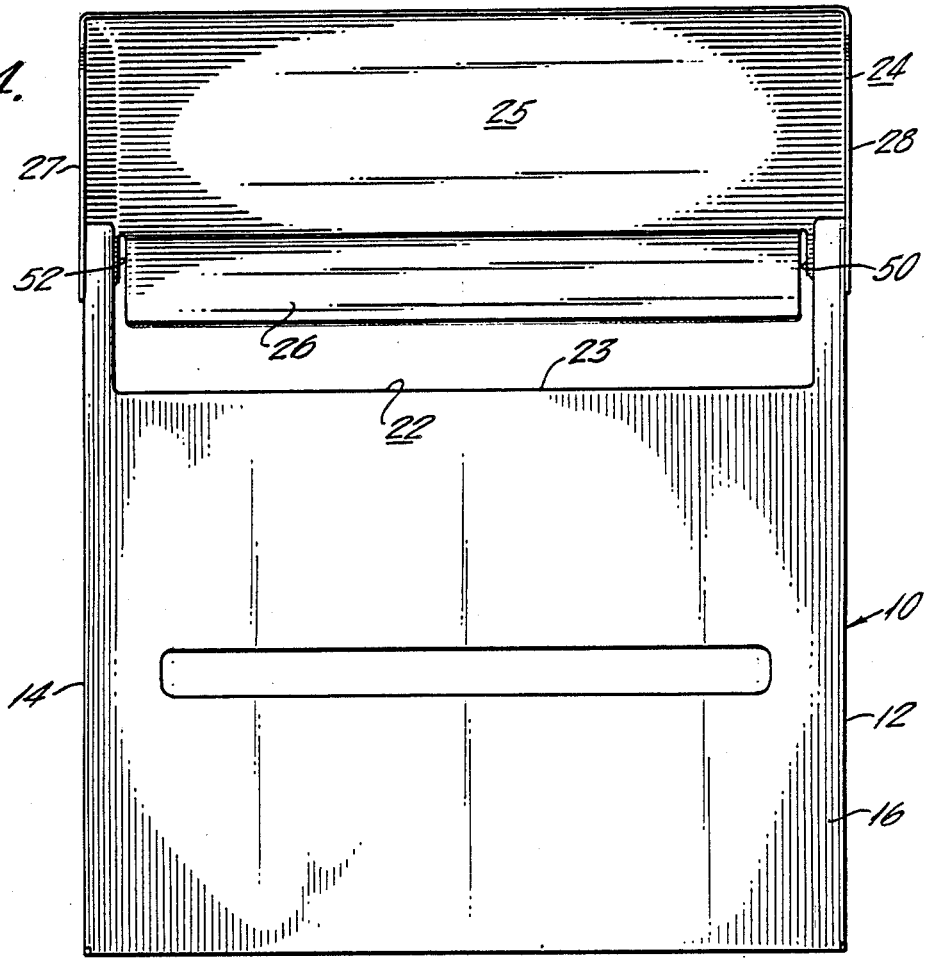
FIG. 4 is a top plan view of the stand of FIG. 2.
Figure 5:
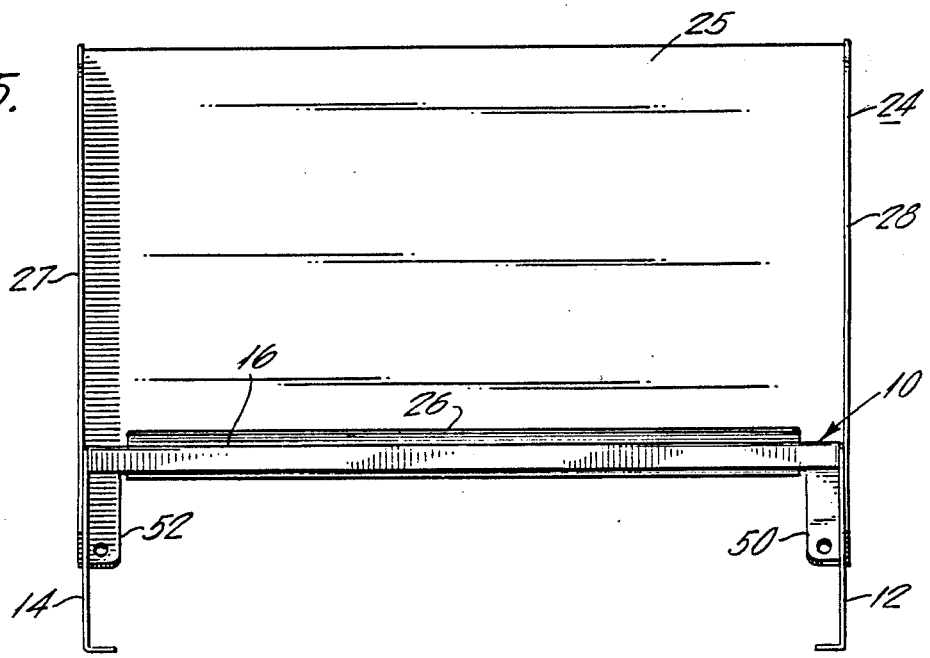
FIG. 5 is a front elevational view of the stand of FIG. 2.
Figure 6:
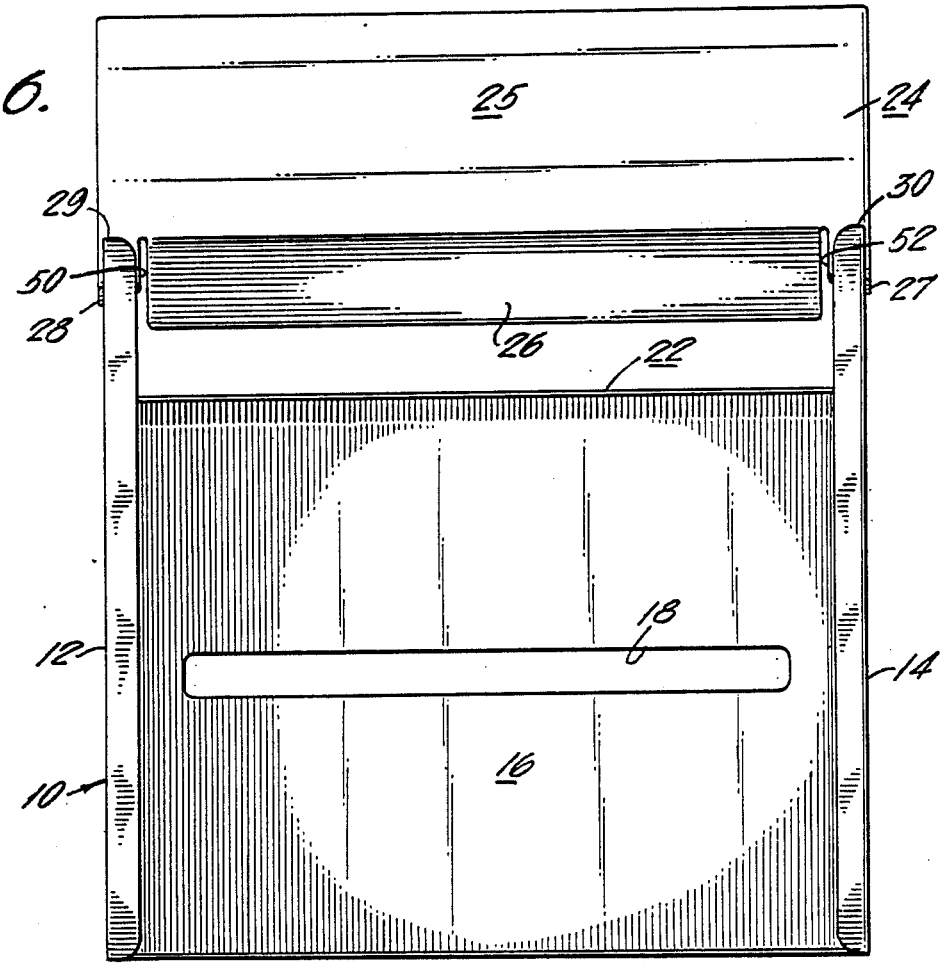
FIG. 6 is a bottom plan view of the stand of FIG. 2.
Figure 7:
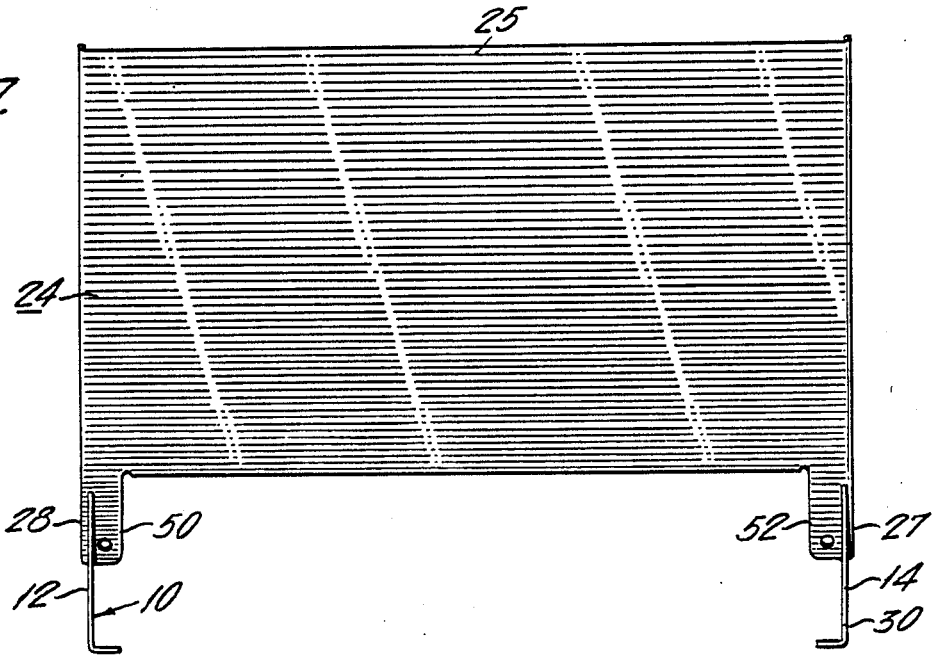
FIG. 7 is a rear elevational view of the stand of FIG. 2.

Turning now to the specific embodiment of the invention shown in the examples by way of illustration only, and without thereby limiting the scope of the invention, a support base 10 is provided having opposite side walls 12 and 14 and a top 16. It is typically made of sheet metal, and is provided with a transverse slot 18 through which print-out paper 19 stacked below the stand may be fed upwardly into the bottom of a bottom feeding type of printer 20. The rear of the top of the stand is provided with a recess 22 (FIG. 2) wider than the width of the print-out paper so that print-out paper stored below or behind the stand can be fed upwardly through this rear opening and into the rear of a printer of the rear fed type, the edge 23 of the recess 22 is preferably rounded to provide a smooth surface over which the paper may slide.

The paper catcher 24 comprises a flat imperforate backer panel 25 provided with a bent-up lower edge 26 and bent-up side flanges 27 and 28.

The rear edges 29 and 30 of the two side walls 12 and 14 are provided with respective slots 31 and 32 extending at an angle of about 20°to 25°from the vertical, and with ledge 26 extending substantially at right angles to the backer panel 25 of catcher 24.

It will be appreciated that the catcher, and indeed the base or support base as well, may be made very inexpensively by simple cutting and bending operations. The base requires merely the slitting and bending-up of the various flanges, ledge 26, the simple bending-up of the side flanges 27 and 28, the cut-out of the slots 31 and 32, the cut-out of the recess 22 in the top of the base and the cut-out of the opening 18. All of the cut-outs may be made prior to performing the bending operation on the flat piece of original sheet metal, by simple stamping for example.

More particularly, the catcher may be formed from flat sheet metal stock by making cuts at 50 and 52 to define the edges of the ledge, after which the ledge and the side flanges may be formed by appropriate bending operation. Two cuts and three simple bends are all that is required to make the catcher of the invention from a a piece of flat sheet metal stock, with resultant decrease in cost of manufacture.

Figure 1:
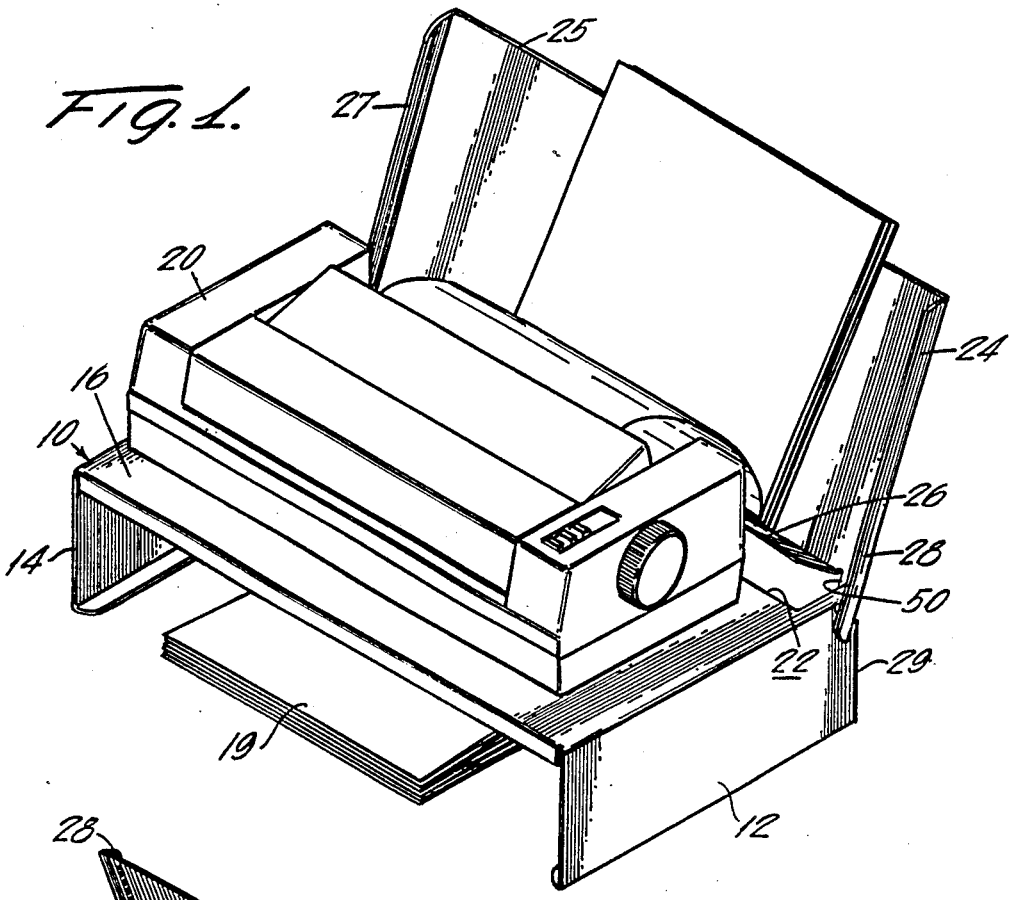
FIG. 1 is a perspective view of the support base and print-out paper catcher in accordance with the preferred embodiment of the invention, shown assembled to each other with a printer on the support base.
Figure 8:
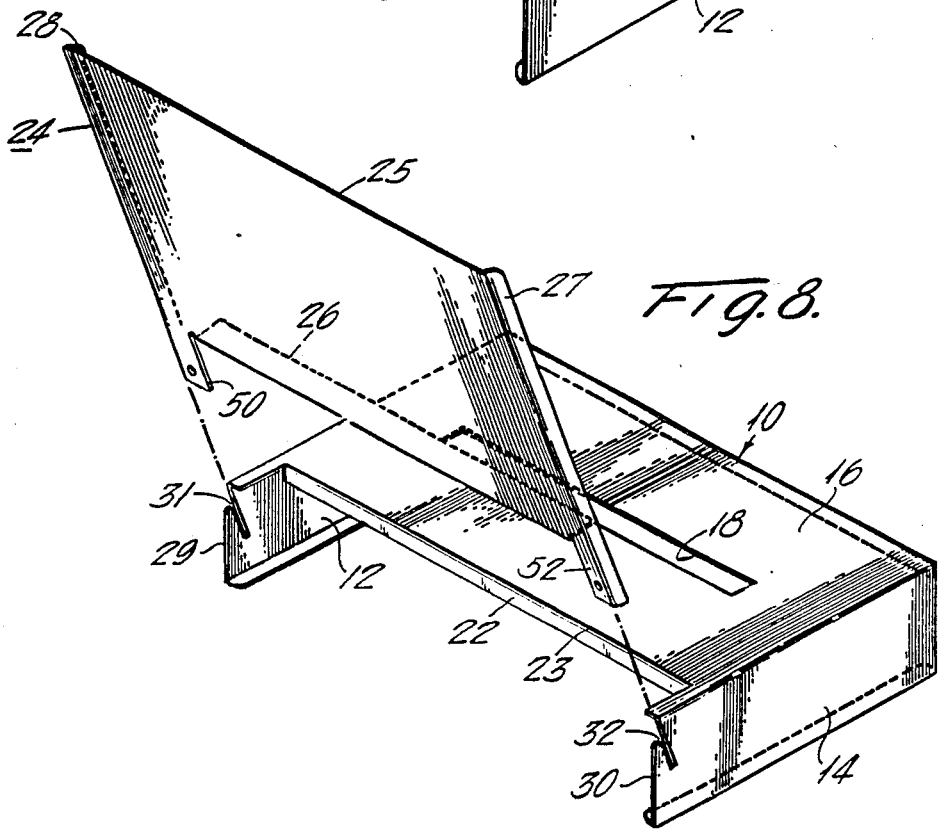
FIG. 8 is a perspective view of the stand of FIG. 2, showing the catcher removed from the support base.

In operation, the catcher backer panel is slid into the slots 31 and 32 (FIG. 8) to assemble the stand; the printer is placed on the support base appropriate print-out paper is fed to the printer, and the print-out paper ejected rearwardly from the printer then cascades rearwardly into the ledge of the catcher.

Accordingly, there has been provided a paper catcher system which provides for the stable accumulation on it of print-out paper from a printer, with the accumulated sheets lying in a packet extending obliquely upwardly and rearwardly from the printer as desired, the catcher and base being extremely simple to assembly and disassemble and particularly inexpensive to manufacture.

While the invention has been shown and described with particular reference to specific embodiments therof in the interest of complete definiteness, it will be understood that it may be embodied in a variety of forms diverse from those specifically shown and described without departing from the spirit and scope of the invention.

What is claimed is:

1. A printer stand for supporting a printer and for catching and accumulating sheets of paper from said printer, comprising:

a printer support base having laterally spacedapart side walls and having a top extending between said side walls for supporting a printer which ejects sheets of printed paper rearwardly:

a paper catcher removably mountable on said support base rearwardly of the position of said printer, for catching and accumulating sheets of paper ejected from said printer;

said catcher comprising a backer panel for supporting the rear side of a packet of said sheets of paper delivered thereto from said printer, and a ledge extending forwardly along the lower edge of said backer panel for supporting said packet of sheets of paper, said panel extending rearwardly and upwardly behind said base;

each of said side walls of said base having a slot formed therein, extending forwardly and downwardly from its rear side, said slots being positioned and configured to permit said panel to be slid in and out of them and to rest therein in rearwardly and upwardly extending stable position when receiving said sheets of paper from said printer.

2. The printer stand of claim 1, wherein said panel extends upwardly and rearwardly at from about 20°to 25°to the horizontal, when installed in said slots.

3. The printer stand of claim 1, wherein said ledge extends both forwardly and upwardly when said panel is installed in said slots.

4. The printer stand of claim 3, wherein said ledge extends substantially perpendicularly to said panel.

5. The printer stand of claim 1, wherein said paper catcher comprises a pair of forwardly-extending flanges along its side edges which are laterally spaced apart by slightly more than the distance between the outer sides of said side walls adjacent said slots.

6. A printer stand comprising:

a substantially box-like base support having a pair of opposed side walls and a top supported by said side walls;

a slot in each of said side walls at its rear end, each said slot being open to the exterior and extending downwardly and forwardly;

a paper catcher comprising a flat central panel of continuous imperforate material having a width at least as great as the spacing between said slots and having a thickness less than the transverse dimension of each of said slots, whereby said panel can be slid in and out of said slots and stably seated therein at an upwardly and rearwardly extending angle;

said catcher having a bent-up ledge along its bottom edge for supporting the lower edges of paper sheets supplied thereto from a printer on said stand, and having bent-up side flanges spaced apart by slightly more than the distance between the outer side of said side walls for aiding in the centering of said catcher in said slots and in the centering of said paper in said catcher.

* * * * *